United States Patent [19]

Ikenoue et al.

[11] 4,156,611

[45] May 29, 1979

[54] HEAT-DEVELOPABLE PHOTOSENSITIVE MATERIALS

[75] Inventors: Shinpei Ikenoue; Takao Masuda, both of Asaki; Akira Ogawa, Minami-ashigara; Akira Sato, Minami-ashigara; Yuji Mihara, Minami-ashigara, all of Japan

[73] Assignee: Fuji Photo Film Co., Ltd., Minami-ashigara, Japan

[21] Appl. No.: 777,804

[22] Filed: Mar. 15, 1977

Related U.S. Application Data

[63] Continuation-in-part of Ser. No. 543,104, Jan. 23, 1975, abandoned.

[30] Foreign Application Priority Data

Jan. 22, 1974 [JP] Japan ..... 49-9565

[51] Int. Cl.[2] ..... G03C 1/02; G03C 1/08; G03C 1/14; G03C 1/10

[52] U.S. Cl. ..... 96/114.1; 96/122; 96/126; 96/139; 96/114.6

[58] Field of Search ..... 96/114.1, 120, 122, 96/139, 106, 126, 114.6

[56] References Cited

U.S. PATENT DOCUMENTS

| | | | |
|---|---|---|---|
| 2,078,233 | 4/1937 | Brooker | 96/139 X |
| 2,185,182 | 1/1940 | Brooker | 96/139 X |
| 2,944,896 | 7/1960 | Riester | 96/139 X |
| 2,977,229 | 3/1961 | Jones | 96/126 |
| 3,457,075 | 7/1969 | Morgan et al. | 96/114.1 X |
| 3,666,477 | 5/1972 | Goffe | 96/114.1 |
| 3,756,829 | 9/1973 | Ohkubo et al. | 96/114.1 |
| 3,761,279 | 9/1973 | de Mauriac | 96/114.1 |

OTHER PUBLICATIONS

Hamer, F. M. The Cyanine Dyes and Related Compounds: 1964. Interscience Publishers, John Wiley & Sons, N. Y. pp. 534–538.

*Primary Examiner*—Edward C. Kimlin
*Assistant Examiner*—Alfonso T. Suro Pico
*Attorney, Agent, or Firm*—Sughrue, Rothwell, Mion, Zinn and Macpeak

[57] ABSTRACT

A heat-developable photosensitive material which comprises a support having thereon at least one layer containing (a) an organic silver salt, (b) a catalytic amount of a photosensitive silver halide or a compound which forms a photosensitive silver halide, (c) a reducing agent, and (d) at least one sensitizer selected from the group consisting of compounds represented by the formulae (I) and (II):

(I)

(II)

wherein R represents an unsubstituted or substituted alkyl group having 1 to 4 carbon atoms or an aryl group; and Q represents a group of atoms necessary to complete a rhodanine nucleus, a thiohydantoin nucleus or a 2-thio-2,4-oxazolidine-dione nucleus and wherein said compound represented by the formulae (I) and (II) include at least one carboxyl group as a substituent, and (e) a binder.

17 Claims, No Drawings

HEAT-DEVELOPABLE PHOTOSENSITIVE MATERIALS

This application is a continuation-in-part of U.S. Ser. No. 543,104, now abandoned, filed Jan. 23, 1975.

BACKGROUND OF THE INVENTION

1. Field of the Invention

The present invention relates to heat-developable photosensitive materials. Particularly, it relates to heat-developable photosensitive materials having a layer of high sensitivity.

2. Description of the Prior Art

The photographic process using silver halide has been most widely practiced hitherto, because the photographic process using silver halide provides excellent photographic properties such as good sensitivity or gradation as compared with other photographic processes such as an electrophotographic process or a diazo photographic process. However, silver halide photosensitive materials used in this process must be subjected to development using a developer after image exposure and then subjected to various processings such as stopping, fixation, water wash or stabilization so that the areas which were not developed (hereinafter, called background) do not blacken. Accordingly, these processings are time-consuming and labor-some. Further, there are problems in that the handling of chemicals is dangerous to humans or the hands and clothes of workers in the processing room are stained at processing. Thus, it is very desired to improve the photographic process using silver halide so that the processings are carried out in a dry state without carrying out solution processing and the processed images can be preserved in a stabilized condition.

Therefore, many efforts have been made hitherto. A first attempt is the so-called combined developing-fixing process as described in, for example, U.S. Pat. No. 2,875,048, British Pat. No. 954,453 and German Pat. No. 1,163,142 wherein the development and the fixation are carried out in one processing as in the prior silver halide photographic process. A second attempt is to convert the wet processings in the silver halide photographic process into dry processings as described in, for example, German Pat. No. 1,174,159 and British Pat. Nos. 943,376 and 951,644. A third attempt is to use heat-developable photosensitive materials which contain a silver salt, for example, a silver salt of a higher fatty carboxylic acid such as silver behenate, silver saccharin or silver benzotriazole as a main photosensitive element and a catalytic amount of silver halide as described in U.S. Pat. Nos. 3,152,904, 3,457,075, 3,635,719, 3,645,739 and 3,756,829 and Canadian Pat. No. 811,677.

The present invention belongs to the third of the above described three attempts.

However, in the heat-developable photosensitive materials proposed heretofore, sufficient light sensitivity has not been obtained.

It is known by, for example, U.S. Pat. Nos. 3,457,075 and 3,761,279 that merocyanine dyes are effective as spectral sensitizers for silver halide emulsions for sensitizing heat-developable photosensitive materials. However, since all of the spectral sensitizers which are effective for silver halide emulsions are not always effective in general for heat-developable photosensitive materials, prediction of what kind of structure would be effective as a sensitizer for heat-developable photosensitive materials is difficult. Further, many heat developable photosensitive materals lack sensitivity to light in the blue range (light having a wavelength below 500 nm, hereinafter "blue light range") as described in U.S. Pat. No. 3,761,279. In the dyes described in U.S. Pat. No. 3,761,279, although sensitivity to the blue light range has been improved, the sensitivity is not sufficient. In these cases, it is not possible to predict what kind of sensitizer has high sensitivity to the blue light range.

SUMMARY OF THE INVENTION

An object of the present invention is to provide heat-developable photosensitive materials having a sensitized photosensitive layer.

Another object of the present invention is to provide heat developable photosensitive materials having high blue sensitivity.

A further object of the present invention is to provide heat-developable photosensitive materials containing a sensitizer having an excellent sensitization in the blue light range.

As the result of much research in order to obtain sensitizers effective for heat-developable photosensitive materials, it has now been discovered that sensitizers represented by the formulae (I) and (II) hereinafter described are particularly excellent sensitizers for heat developable photosensitive materials.

The present invention provides a heat developable photosensitive material which comprises a support having thereon one or more layers containing at least (a) an organic silver salt, (b) a catalytic amount of a photosensitive silver halide or a compound which forms a photosensitive silver halide by reaction with the organic silver salt, (c) a reducing agent, (d) at least one sensitizer selected from the group consisting of sensitizers represented by the following formulae (I) and (II)

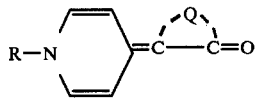

(I)

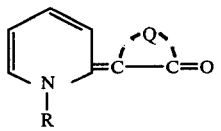

(II)

wherein R represents an unsubstituted or substituted alkyl group having 1 to 4 carbon atoms or an unsubstituted or substituted aryl group, and Q represents a group of atoms necessary to complete a rhodanine nucleus, a thiohydantoin nucleus or a 2-thio-2,4-oxazolidine-dione nucleus and wherein said compound represented by the formulae (I) and (II) include at least one carboxyl group as a substituent, and (e) a binder.

DETAILED DESCRIPTION OF THE INVENTION

As described above the sensitizers used in the present invention are compounds represented by the following formulae (I) and (II)

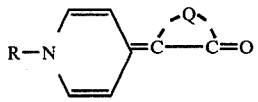

(I)

-continued (II)

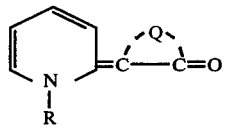

In the formulae (I) and (II), Q represents a group of atoms necessary to complete a rhodanine nucleus, a thiohydantoin nucleus or 2-thio-2,4-oxazolidinedione nucleus. Preferably, the 3-position of the Q nucleus has a carbon containing substituent having 1 to 15 carbon atoms, e.g., a substituted or unsubstituted alkyl group, a substituted or unsubstituted aryl group, and a substituted or unsubstituted alkenyl group are preferred. When the Q nucleus is a thiohydantoi nucleus, preferably the 1-position thereof also has a carbon containing substituent having 1 to 15 carbon atoms. These carbon containing substituents can be substituted with a carboxyl group, a sulfo group, an alkali metal salt of a sulfo group, or a hydroxyl group. Preferred alkali metals are lithium, sodium and potassium. Substituted or unsubstituted alkyl groups having 1 to 8 carbon atoms, alkenyl groups having 2 to 4 carbon atoms, and aryl groups having 6 to 12 carbon atoms are preferred as the carbon containing substituents. Particularly preferred examples of substituents for the alkyl group, are a carboxy group, a sulfo group, an alkali metal salt of a sulfo group a hydroxy group, and an aryl group and particularly preferred examples of substituents for the aryl group are a carboxyl group, a sulfo group, an alkali metal salt of a sulfo group and an alkyl group. Examples of these groups include an alkyl group such as a methyl, ethyl, propyl, or butyl, etc., group, a carboxyalkyl group such as a carboxymethyl, β-carboxyethyl or γ-carboxypropyl, etc. group, a sulfoalkyl group such as a β-sulfoethyl or γ-sulfopropyl, etc. group, hydroxyalkyl groups such as γ-hydroxyethyl, etc. groups, a vinylmethyl group, a phenyl group, a benzyl group, a tolyl group, a carboxyaryl group such as a p-carboxyphenyl or m-carboxyphenyl, etc. group, and a sulfoaryl group such as a p-sulfophenyl, etc. group. R represents a substituted or unsubstituted alkyl group having 1 to 4 carbon atoms or a substituted or unsubstituted aryl group having 6 to 12 carbon atoms. Particularly preferred substituents for the alkyl group for R are a carboxy group, a sulfo group, an alkali metal salt of a sulfo group, a hydroxy group and a vinyl group, and particularly preferred substituents for the aryl group for R are a carboxy group, a sulfo group, and an alkali metal salt of a sulfo group. Examples of these substituents include an alkyl group such as a methyl, ethyl, propyl, butyl, etc. group, a carboxyalkyl group such as a β-carboxyethyl, γ-carboxypropyl or carboxymethyl, etc. group, a sulfoalkyl group such as a β-sulfoethyl, γ-sulfopropyl, γ-sulfobutyl, or γ-sulfobutyl, etc. group, and a hydroxyalkyl group such as a β-hydroxyethyl, etc. group. Particularly, a carboxyalkyl group such as a carboxymethyl, β-carboxyethyl or γ-carboxypropyl group and a vinyl methyl group are preferred.

In the above, R, the substituent of Q or both of them has at least one carboxyl group as a substituent thereof.

Examples of preferred sensitizers include the following compounds.

(1)

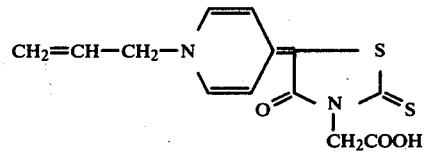

(2)

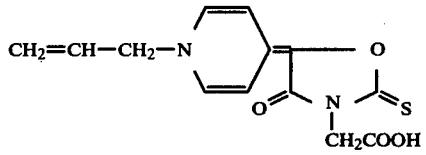

(3)

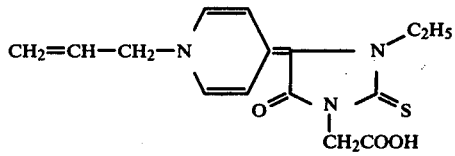

(4)

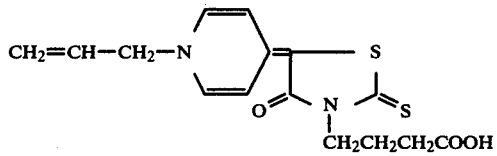

(5)

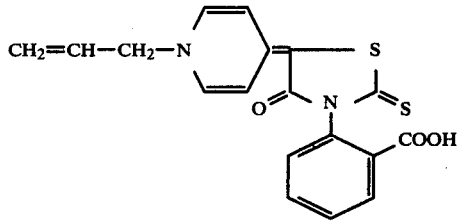

(6)

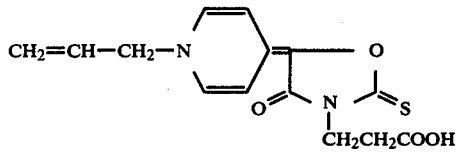

(7)

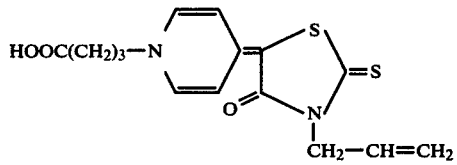

(8)

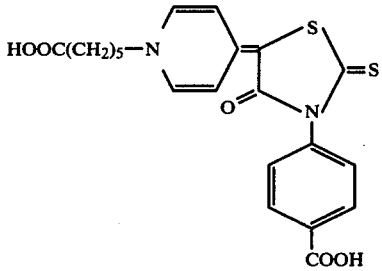

(9)

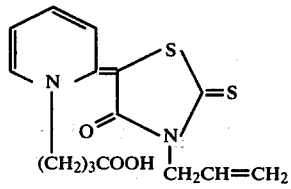

-continued (10)

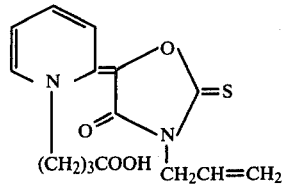

(11)

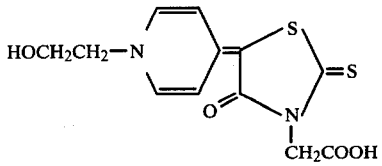

(12)

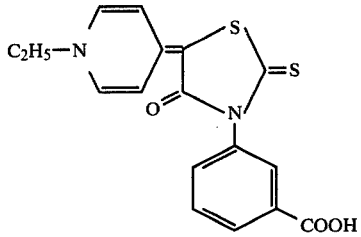

(13)

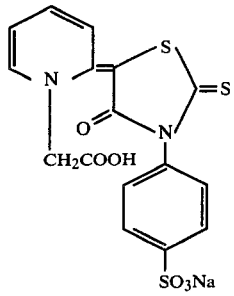

The amount of Component (d) (sensitizer) employed is about $10^{-6}$ mols to $10^{-1}$ mols and preferably about $10^{-4}$ to $10^{-2}$ mols per mol of Component (a) (organic silver salt).

Although sensitivity of the resulting heat-developable photosensitive materials increases as the amount of the sensitizer employed increases, coloration of the photosensitive materials by the sensitizer becomes marked (residual color).

In heat-developable photosensitive materials, it is impossible to wash away the sensitizer by solvents as in wet processing, because they require dry processing. Accordingly, the upper limit of the amount of the sensitizer depends upon the whiteness allowable for use of the heat-developable photosensitive materials.

Further, if the amount of the sensitizer is small, although the residual color caused by the sensitizer decreases, the sensitivity of the heat-developable photosensitive materials decreases. Accordingly, the lower limit of the amount of the sensitizer depends upon the sensitivity allowable for use of the heat-developable photosensitive materials.

The organic silver salts which can be used as component (a) in the present invention are those which are comparatively stable against light, appear colorless, white or lightly colored and form silver (images) upon being heated to a temperature higher than about 80° C., preferably higher than 100° C. in the presence of light-exposed silver halide, by reaction with a reducing agent. Suitable examples of organic silver salts include the silver salts of organic compounds having an imino group, a mercapto group, a thione group or a carboxyl group. Suitable specific examples of these compounds are given in the following.

(1) Silver salts of compounds having an imino group; silver salt of benzotriazole, silver salt of nitrobenzotriazole, silver salt of an alkyl-substituted benzotriazole (e.g., silver salt of methylbenzotriazole, etc.), silver salt of a halogen-substitued benzotriazole (e.g., silver salt of bromobenzotriazole, silver salt of chlorobenzotriazole, etc.), silver salt of a carboimido-substituted benzotriazole (e.g.,

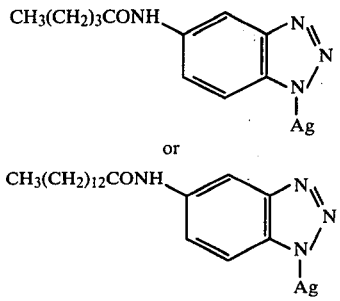

etc.), silver salt of a substituted benzimidazole (e.g., silver salt of 5-chloro-benzimidazole, silver salt of 5-nitrobenzimidazole, etc.), silver salt of carbazole, silver salt of saccharin, silver salt of phthalazinone, silver salt of a substituted phthalazinone, silver salt of a phthalimide, silver salt of pyrrolidone, silver salt of tetrazole, silver salt of imidazole, and the like, (2) Silver salts of compounds having a mercapto group or a thione group;

silver salt of 3-mercapto-4-phenyl-1,2,4-triazole, silver salt of 2-mercapto-benzimidazole, silver salt of 2-mercapto-5-aminothiadiazole, silver salt of 1-phenyl-5-mercaptotetrazole, silver salt of 2-mercaptobenzothiazole, silver salt of 2-(S-ethylthioglycolamido)benzothiazole, silver thioglycolates as described in Japanese Patent Application Laid-open No. 2822/73 (e.g., silver S-alkyl ($C_{12}$–$C_{22}$)-thioglycolate, etc.), silver dithiocarboxylates (e.g., silver dithioacetate, etc.), silver salt of thioamide, silver salt of thiopyridine (e.g., silver salt of 5-carbethoxy-1-methyl-2-phenyl-4-thiopyridine, etc.), silver salt of dithiodihydroxybenzole, silver salt of mercaptotriazine, silver salt of 2-mercaptobenzoxazole, silver salt of mercaptooxadiazole, and the like, (3) Silver salts of compounds having a carboxy group;

(i) silver salts of aliphatic carboxylic acids; silver caprate, silver laurate, silver myristate, silver palmitate silver stearate, silver behenate, silver maleate, silver fumarate, silver tartrate, silver furoate, silver linoleate, silver oleate, silver hydroxystearate, silver adipate, silver sebacate, silver succinate, silver acetate, silver butyrate, silver camphorate, and the like, (ii) silver salts of aromatic carboxylic acids and others; silver benzoate, substituted silver benzoate (e.g., silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.), silver gallate, silver tannate, silver phthalate, silver terephthalate, silver salicylate, silver phenylacetate, silver pyromellitate, silver salt of 4'-n-octadecyloxydiphenyl-4-carboxylic acid, silver salt of a thioncarboxylic acid as described in U.S. Pat. No. 3,785,830, silver salt of an aliphatic carboxylic acid having a thioether group as described in U.S. Pat. No. 3,330,663, and the like.

(4) Other silver salts;

silver salt of 4-hydroxy-6-methyl-1,3,3*a*,7-tetrazaindene, silver salt of 5-methyl-7-hydroxy-1,2,3,4,6-pentazaindene, silver salt of tetrazaindene as described in British Pat. No. 1,230,642, silver salt of S-2-aminophenylthiosulfuric acid as described in U.S. Pat. No. 3,549,379, silver salt of a metal-containing aminoalcohol as described in Japanese Patent Application Laid-open No. 6586/71, silver salt of an organic acid metal chelate as described in Belgian Pat. No. 768,411, and the like.

If necessary, titanium oxide, zinc oxide, carboxylic acids of metals other than silver (e.g., gold laurate, gold stearate, gold behenate, etc.) or a like oxidizing agent can be used in combination with the above described organic silver salts. These silver salts are comparatively stable to light and the silver salts located at the exposed areas are reduced, upon heating, with a reducing agent with the aid of the catalytic action of exposed silver halide to form a silver image.

As a process for producing organic silver salts suitable for the heat-developable photosensitive materials of the present invention, a process which comprises mixing a solution of a silver salt forming organic compound in a suitable solvent with an aqueous solution of a silver salt such as silver nitrate or a silver complex salt is usually utilized. For example, an organic carboxylic acid silver salt produced by adding an aqueous solution of silver nitrate to an aqueous solution of a water soluble carboxylic acid salt (e.g., the sodium salt) can be used as Component (a) of the heat-developable photosensitive materials of the present invention. Further, organic carboxylic acid silver salts produced by the process described in U.S. Pat. No. 3,458,544 can be used. Furthermore, organic carboxylic acid silver salts produced by the processes described in French Pat. No. 2,147,286 and U.S. Pat. No. 3,761,273 can be used. Silver benzotriazole produced by the processes described in Japanese Patent Publication 30270/1969 and Japanese Patent application 43867/1972 can also be used.

It has been said that silver salts of higher fatty acids such as silver behenate or silver stearate, silver benzotriazole and silver saccharin are preferred as image forming compounds. However, in producing the silver salts of higher fatty acids such as silver behenate or silver stearate, a large amount of solvent and large scale equipment are necessary in order to produce them in a large amount at one time resulting in a marked increase in the cost, because raw materials such as behenic acid, salts of behenic acid, stearic acid and salts of stearic acid have low solubility in solvents such as water or methanol, etc. Further, with silver benzotriazole and silver saccharin, an increase in cost is inevitable, because benzotriazole and saccharin used as the raw materials have a higher cost than fatty acids. In addition, silver saccharin and silver benzotriazole do not provide excellent photographic properties. Accordingly, silver salts of fatty acids are preferred. Silver salts of fatty acids having a number of carbon atoms which is too low such as silver acetate are light sensitive and gradually darken on exposure to light. Therefore, these silver fatty acid salts are not suitable where the processed sensitive materials are stored exposed to light for a long period of time. However, they can be used in the same way as other organic silver salts, if they are used temporarily, and thus they are included within the scope of the present invention. Middle chain length fatty acid silver salts, for example, silver caprate and silver laurate are most preferred organic silver salts, because they do not have the above described defects.

The catalytic amount of the photosensitive silver halide Component (b) used in the present invention can be introduced into the heat-developable photosensitive layer using a method which comprises mixing the previously formed silver halide Component (b) with an organic silver salt, a method which comprises converting a portion of an organic silver salt component (a) into silver halide by contacting the organic silver salt with halogen ions, or a method which comprises forming the silver halide and the organic silver salt at the same time. For example, the silver halide can be introduced into the heat-developable photosensitive layer using the methods described in U.S. Pat. Nos. 3,152,904, 3,457,075, 3,700,458, 3,706,564 and 3,761,273, French Pat. Nos. 2,107,162 and 2,078,586 and Belgian Pat. No. 774,436.

As the silver halide Component (b) silver chloride, silver bromide, silver iodobromide, silver bromochloride, silver iodobromochloride and silver iodide can be used. Particularly, silver bromide, silver iodobromide or silver iodobromochloride containing above about 70 mol% of bromide and silver bromochloride containing above about 50 mol% of bromide are preferred. Use of silver halide having a high iodide content is subject to restriction because the silver halide becomes yellow colored. The following compounds can be used as the compound which forms the photosensitive silver halide Component (b).

Namely, inorganic compounds represented by the formula $MX_n$ are suitable. In the formula, M represents a hydrogen atom, an ammonium group or a metal atom (e.g., strontium, cadmium, zinc, tin, chromium, sodium, barium, iron, cesium, lanthanum, copper, calcium, nickel, magnesium, potassium, aluminum, antimony gold, cobalt, mercury, lead, beryllium, lithium, manganese, gallium, indium; rhodium, ruthenium, palladium, iridium, platinum, thallium, or bismuth, etc.), X represents a halogen atom (i.e., chlorine, bromine or iodine) and n is 1 when M is a hydrogen atom or an ammonium group, and n is the valency of the metal atom when M is a metal atom.

Further, organic halogen compounds such as triphenylmethyl chloride, triphenylmethyl bromide, 2-bromo-2-methylpropane, 2-bromo-butyric acid, 2-bromoethanol, dichlorobenzophenone, iodoform, bromoform, carbon tetrabromide, N-haloacetamide, 1,3-dibromo-5,5-dimethylthiohydantoin or 1,3-dichloro-5,5-dimethylthiohydantoin are also effective as the compound which forms a photosensitive silver halide.

Further, onium halides such as cetylethyldimethyl ammonium bromide or trimethylbenzyl ammonium bromide, etc. are also effective as the compound which forms a photosensitive silver halide.

The above described compounds which form photosensitive silver halide can be used individually or as a combination of two or more thereof. They are used in the amount of about 0.001 to 0.5 mols and preferably 0.01 to 0.2 mols per mol of the organic silver salt Component (a). If the amount is less than about 0.001 mol per mol of the organic silver salt, the sensitivity is reduced. If the amount is above about 0.5 mol per mole of the organic silver salt discoloration by light occurs and the contrast between the image area and the background decreases. Here, discoloration by light means that the non-image area (background) gradually darkens when the sensitive material developed by heating is allowed to stand under room light.

The reducing agent Component (c) used in the present invention should be a compound which reduces the organic silver salt Component (a) to form silver images when heated in the presence of the exposed silver halide catalyst Component (b). Suitable reducing agents are determined by the particular silver salt Compound (a) as an oxidizing agent used, and they can be selected from the following compounds.

(1) Monohydroxybenzenes
(2) Dihydroxybiphenyls
(3) Di- or polyhydroxybenzenes
(4) Naphthols, naphthylamines and aminonaphthols
(5) Hydroxybinaphthyls
(6) Aminophenols
(7) p-Phenylenediamines
(8) Alkylene-bisphenols
(9) Ascorbic acid and derivatives thereof
(10) Pyrazolidones Examples of these compounds are as follows.

(1) Monohydroxybenzenes:

p-Phenylphenol, o-phenylphenol, p-ethylphenol, p-t-butylphenol, p-sec-butylphenol, p-t-amylphenol, p-methoxyphenol, p-ethoxyphenol, p-cresol, 2,6-di-t-buty-p-cresol, 2,4-xylenol, 2,6-xylenol, 3,4-xylenol, p-acetylphenol, 1,4-dimethoxyphenol, 2,6-dimethoxyphenol, hydroquinone mono-n-hexyl ether, hydroquinone monobenzyl ether and chlorothymol, etc.

(2) Dihydroxybiphenyls:

3,3',5,5'-Tetra-t-butyl-4,4'-dihydroxybenzene, etc.

(3) Di- or polyhydroxybenzenes:

Hydroquinone, methylhydroquinone, t-butylhydroquinone, 2,5-dimethylhydroquinone, 2,6-dimethylhydroquinone, t-octylhydroquinone, phenylhydroquinone, methoxyhydroquinone, ethoxyhydroquinone, chlorohydroquinone, bromohydroquinone, hydroquinone monosulfonic acid salt, catechol, 3-cyclohexylcatechol, resorcinol, gallic acid, methyl gallate, and n-propyl gallate, etc.

(4) Naphthols, naphthylamines and aminonaphthols:

α-Naphthol, β-naphthol, 1-hydroxy-4-methoxynaphthalene, 1-hydroxy-4-ethoxynaphthalene, 1,4-dihydroxynaphthalene, 1,5-dihydroxynaphthalene, 1-hydroxy-2-phenyl-4-methoxynaphthalene, 9-hydroxy-2-methyl-4-methoxynaphthalene, potassium 1-amino-2-naphthol-6-sulfonate, 1-hydroxy-4-aminonaphthalene and 1-naphthylamino-7-sulfonic acid, etc.

(5) Hydroxybinaphthyls:

1,1'-Dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl and bis-(2-hydroxy-1-naphthyl)methane, etc.

(6) Aminophenols:

p-Aminophenol, o-aminophenol, 2,4-diaminophenol, N-methyl-p-aminophenol, 2-methoxy-4-aminophenol, and 2-β-hydroxyethyl-4-aminophenol, etc.

(7) p-Phenylenediamines:

N,N'-Diethyl-p-phenylenediamine and N,N'-Dibenzylidene-p-phenylenediamine, etc.

(8) Alkylene bisphenols:

1,1-bis-(2-Hydroxy-3-t-butyl-5-methylphenyl)methane, 1,1-bis-(2-hydroxy-3,5-dimethylphenyl)-3,5,5-trimethylhexane, 1,1-bis-(2-hydroxy-3,5-di-t-butylphenyl)-2-methylpropane, 2,2-bis-(4-hydroxy-3-methylphenyl)propane, 4,4-bis-(4-hydroxy-3-methylphenyl)-heptane, 2,2-bis-(4-hydroxy-3-isopropylphenyl)propane, 2,2-bis-(4-hydroxy-3-phenylphenyl)propane, 1,1-bis-(4-hydroxy-3-methylphenyl)cyclohexane, 2,2-bis-(4-hydroxy-3,5-dimethylphenyl)propane, 2,2-bis-(4-hydroxy-3-t-butyl-5-methylphenyl)propane, 3,3-bis-(4-hydroxy-3-t-dodecylphenyl)hexane, (4,4'-dihydroxy-3-methyldiphenyl)-2,2-propane, (4,4'-dihydroxy-3-t-octyldiphenyl)-2,2-propane, (4,4'-dihydroxy-3-t-butyldiphenyl)4-methyl-2,2-pentane, (4,4'-dihydroxy-3-methyl-3'-t-butyldiphenyl)2,2-propane, (4,4'-dihydroxy-3-methyl-5-t-butyldiphenyl)-2,2-propane, 2,2-bis-(4-hydroxyphenyl)propane, (4,4'-dihydroxy-3,3',5-trimethyldiphenyl)-3,3-pentane, N-(4-hydroxyphenyl)-salicylamide, 2,2-bis-(3,5-dibromo-4-hydroxyphenyl)-propane and bis-(3-methyl-4-hydroxy-5-t-butylphenyl)-sulfide, etc.

(9) Ascorbic acid and derivatives thereof:

l-Ascorbic acid, esters such as ethyl l-ascorbate, and diesters such as diethyl l-ascorbate, etc.

(10) Pyrazolidones:

1-Phenyl-3-pyrazolidone and 4-methyl-4-hydroxymethyl-1-phenyl-3-pyrazolidone, etc.

These reducing agents Component (c) can be used individually or as a combination of two or more thereof. A suitable reducing agent can be selected on the basis of the particular organic silver salt Component (a) with which the reducing agent is used. For example, relatively strong reducing agents, for example, bisphenols such as 4,4'-methylenebis-(3-methyl-5-t-butylphenol) are suitable for higher fatty acid silver salts such as silver behenate, because higher fatty acid silver salts are relatively difficult to reduce. On the other hand, relatively weak reducing agents, for example, substituted phenols such as p-phenylphenol are suitable for silver salts which are easily reduced such as silver laurate. Further, strong reducing agents such as ascorbic acid are suitable for silver salts which are very difficult to reduce such as silver benzotriazole. Suitable reducing agents for silver caprate and silver laurate which are particularly preferred organic silver salts Component (a) of the present invention are substituted phenols, substituted or unsubstituted bisphenols, hydroquinone monoethers and thymols, etc.

Examples of these compounds including the above described common reducing agents are as follows. Namely, 1,1-bis-(4-hydroxyphenyl)cyclohexane, 1,1-bis-(5-chloro-2-hydroxyphenyl)-methane, diethylstilbestrol, hexestrol, 2,2-bis-(-3,5-dibromo-4-hydroxyphenyl)propane, α-phenyl-o-cresol, hydroquinone monobenzyl ether, p-nonylphenol, p-octylphenol, p-ethylphenol, p-secbutylphenol, p-t-amylphenol, p-acetylphenol, 2-acetoacetyl-4-methylphenol, 1-(2-quinolyl)-3-methyl-5-pyrazolone, 1-chloro-2,4-dihydroxybenzene, 3,5-di-t-butyl-2,6-dihydroxybenzoic acid, 2,4-dihydroxybenzoic acid, resorcinol, 2,4-dihydroxyphenyl sulfide, 5,7-dihydroxy-4-methylcoumarin, p-methoxyphenol, 2-t-butyl-4methoxyphenol, p-phenylphenol, p-t-butylphenol, β-naphthol, 2,4,5-trimethylphenol, bisphenol A, 2,5-di-t-butyl-4-methoxyphenol, hydroquinone mono-n-propyl ether, hydroquinone mono-n-hexyl ether, 2,3-dimethylphenol, 2,4-di-t-butylphenol, N,N'-di-(4-hydroxyphenyl)-urea, chlorothymol, 2,2-bis-(3,5-dimethyl-4-hydroxyphenyl)propane and 2,2-bis-(3-methyl-4-hydroxyphenyl)propane, etc., are suitable.

The amount of the reducing agent employed in the present invention can not be set forth unequivocally, because the amount will vary depending on the species of the reducing agent. However, in general, about 0.1 to 5 mols and preferably 0.2 to 2 mols per mol of the organic silver salt Component (a) are preferred.

Of course, these reducing agents can be used as a combination of two or more thereof, as well.

Further, the heat-developable photosensitive materials of the present invention preferably include a toning agent such as phthalazinones, phthalimides or oxazinediones. The preferred amount of the toning agent is about 0.1 to 2 mols per mol of the organic silver salt Component (a).

In the present invention, Components (a), (b), (c) and (d) are dispersed in (e) binders and applied to a support. In such case, all of the Components (a), (b), (c) and (d) can be dispersed in one binder and applied as one layer to the support, or Components (a) and (b) and Components (c) and (d), Components (a), (b) and (d) and Component (c) or Components (a), (b) and (c) and Component (d) can be dispersed in binders respectively and applied separately to the support so as to form a multilayer structure. Any binder material used in this field can be used. In general, hydrophobic binders are preferred. However, hydrophilic binders can be used. Preferred binders are those which are transparent or semitransparent. For example, natural materials such as gelatin, gelatin derivatives, a mixture thereof with a latex, vinyl polymers, cellulose derivatives and synthetic polymers, etc., are suitable. Specific examples of binders include gelatin, phthalated gelatin, polyvinylbutyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadienestyrene copolymers, vinyl acetate-vinyl chloride-maleic acid terpolymers, polyvinyl alcohol, polyvinyl acetate, benzyl cellulose, cellulose diacetate, cellulose triacetate, cellulose propionate and cellulose acetate phthalate, etc. These binders can be used individually and, if desired, as a mixture of two or more thereof.

A preferred ratio by weight of the binder to the organic silver salt Component (a) is about 10 to 1 to 1 to 10 and preferably 4 to 1 to 1 to 4.

A preferred amount of silver applied to the support ranges from about 0.2 to 3 g per $m^2$ and more preferably 0.4 to 2 g per $m^2$ of the support. If the amount is below about 0.2 g per $m^2$ of the support, sufficient image density can not be obtained. If the amount is higher than about 3 g per $m^2$ of the support, photographic properties are not improved while the cost increases.

If desired, the heat-developable photosensitive materials used in the present invention can contain a matting agent, for example, starch, titanium doxide, zinc oxide, silica or kaolin. Further, they may contain a fluorescent whitening agent, for example, a stilbene, a triazine, an oxazole or a coumarin fluorescent whitening agent.

The heat-developable photosensitive layers of the present invention can be coated on the support using various methods. Examples of suitable methods include a dip coating method, an air-knife coating method, a curtain coating method and an extrusion coating method using a hopper as described in U.S. Pat. No. 2,681,294. If desired, two or more layers can be coated at the same time.

Some types of spectral sensitizers useful for silver halide emulsions can be advantageously used together with the sensitizer of the present invention in order to enhance the sensitivity further. For example, the heat-developable photosensitive materials of this invention can be spectrally sensitized by adding a sensitizing dye as a solution or dispersion in an organic solvent. Suitable spectral sensitizers which can be used are acid dyes such as merocyanine dyes, rhodacyanine dyes, styryl dyes, erythrosine, Eosine and fluoroesceine, etc. The amount of these dyes is about $10^{-6}$ to about $10^{-2}$ mols per mol of the organic silver salt Component (a).

Further, the heat-developable photosensitive layers can contain various additives, for example, an anti-heat-fogging agent such as N-bromosuccinimide, N-chlorosuccinimide, N-iodosuccinimide or an N-haloimide described in Japanese Patent application 8194/1973, a stabilizer (a compound which prevents discoloration of images on the lapse of time after image formation) such as benzene sulfonic acid, p-toluene sulfonic acid, tetrabromophthalic acid or tetrabromophthalic acid anhydride, and an antifogging agent such as benzotriazole or a derivative thereof or 1-phenyl-5-mercaptotetrazole. Further it is preferred to add a fatty acid having 10 or more carbon atoms such as capric acid, lauric acid, myristic acid, palmitic acid, stearic acid, arachidic acid, behenic acid, cerotic acid and particularly a fatty acid having a larger number of carbon atoms than palmitic acid in order to prevent discoloration by light.

Furthermore, a top coat polymer layer can be provided on the photosensitive layers, if desired, in order to increase the transparency of the heat-developable photosensitive layers, to increase the image density and to improve raw storability (the property that the photographic properties which the photosensitive material possesses just after production are maintained on storage). A preferred thickness of the top coat polymer layer is about 1 micron to 20 microns. Examples of suitable top-coat polymers include polyvinyl chloride, polyvinyl acetate, copolymers of vinyl chloride and vinyl acetate, polyvinyl butyral, polystyrene, polymethyl methacrylate, polyurethane rubbers, xylene resins, benzyl cellulose, ethyl cellulose, cellulose acetate butyrate, cellulose diacetate, cellulose triacetate, polyvinylidene chloride, chlorinated polypropylene, polyvinylpyrrolidone, cellulose propionate, polyvinyl formal, cellulose acetate phthalate, polycarbonate and cellulose acetate propionate, etc.

It is further preferred that the top coat polymer layer contains a material such as kaolin or silica (silicon dioxide), etc., because the presence of such a material in the top coat polymer layer enables the heat-developable photosensitive material to be written upon with a ball point pen or a pencil after image formation. In addition, the top coat polymer layer can contain an ultraviolet light absorbing agent or a higher fatty acid.

Many kinds of materials can be used as the support. Typical examples of supports include a cellulose nitrate film, a cellulose ester film, a poly-(vinyl acetal) film, a polystyrene film, a poly-(ethylene terephthalate) film, a polycarbonate film, glass, paper and metals, etc. A paper support containing clay is preferred as a paper support. Further, the paper support can contain sytrene-butadiene rubber, polysaccharide, for example, starch or a higher fatty acid.

The above described heat-developable photosensitive materials can be developed merely by heating after exposure for preferably about $10^{-9}$ sec. to $10^3$ sec., particularly preferably $10^{-8}$ sec. to $10^2$ sec., to light using a light source such as a xenon lamp, a tungsten lamp or a mercury lamp. A suitable temperature at heating is about 80° to 180° C. and preferably 100° C. to 150° C. A higher or lower temperature within the above described range can be used by appropriately prolonging or shortening the heating time. Generally, the development time is about 1 second to 60 seconds.

Many heating means can be utilized for the heat development of the heat-developable photosensitive materials of the present invention. For example, the photosensitive materials can be contacted with a simple heated plate or with a heated drum, or they can be passed through a heated area. Further, they can be heated using high frequency radiation or a laser beam.

It has been found that the heat-developable photosensitive materials of the present invention have especially high light sensitivity.

The present invention is illustrated in greater detail by reference to the following examples. Unless otherwise stated, all parts, percentages, ratios and the like are by weight.

EXAMPLE 1

1.9 g of sodium hydroxide was dissolved in 200 ml of water. To this solution, a solution produced by dissolving 12 g of lauric acid in 100 ml of toluene was added and the mixture was stirred with a stirrer to emulsify. To this emulsion, an aqueous solution of silver nitrate (silver nitrate: 8.5 g, water: 50 cc) was added over a 60 second period to produce silver laurate while stirring (800 rpm, 5 minutes). The precipitated silver laurate was removed and dispersed using a ball mill in 30 mg of polyvinyl butyral and 200 ml of isopropyl alcohol to produce a polymer dispersion. This was designated Solution A. 6 cc of a 1.4% methanol solution of N-bromophthalazinone was added to 50 g of the above described polymer dispersion of the silver salt and the mixture was stirred at 50° C. for 90 minutes. This was designated Solution B. To 25 g of Solution B, materials of the following Composition (I) were added to produce a heat-developable photosensitive composition. This composition was applied to a paper support (art paper) at a coverage of 0.4 g of silver per $m^2$ of the support to produce a heat-developable Photosensitive Material (B - 1).

| Compositin (I) | |
|---|---|
| Dye (1) ($8 \times 10^{-4}$ mols/liter, 2 methoxyethanol solution) | 2 cc |
| Phthalazinone (3% methanol solution) | 8 cc |
| Reducing Agent* (20% acetone solution) | 5 cc |

*Reducing Agent

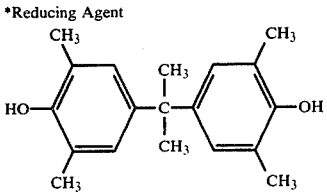

For the purposes of comparison, a heat-developable Photosensitive Material (B - 2) was produced with using Dye (21) (amount added: $8 \times 10^{-4}$ mols/liter, 2-methoxyethanol solution: 2cc) instead of Dye (1).

Dye (21)

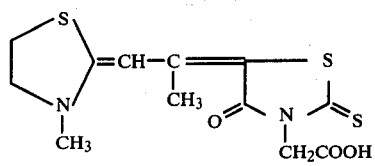

These Photosensitive Materials (B - 1) and (B - 2) were exposed to light through an optical wedge through a filter having a transmission peak at 420 nm (half value width: 50 nm) using a tungsten light source, and developed by heating to 120° C. for 30 seconds to produce black-white images. Then the reflection density was determined. The reciprocal of the exposure necessary to provide a reflection density of 0.1 higher than fog was selected as the standard. The relative speed of Photosenstive Material (B - 1) based on the speed of Photosensitive Material (B - 2) being 100 was 1900.

It is understood that Dye (1) shows a more excellent sensitizing effect to blue light (the relative speed of the heat-developable photosensitive material wherein no dye had been added was 11).

EXAMPLE 2

0.95 g of sodium hydroxide was dissolved in 100 ml of water. To this solution, 5.0 g of lauric acid was dissolved by heating. After the solution was cooled to room temperature (about 20° to 30° C.), a solution of 1 g of lauric acid in 50 ml of toluene was added thereto. To this solution, 50 ml of an aqueous solution containing 4.4 g of silver nitrate and 25 ml of an aqueous solution containing 0.075 g of ammonium bromide were added at the same time while stirring the solution at room temperature with a stirrer. Thus, the solution separated into an oily silver laurate phase (silver bromide as a silver halide catalyst Component (b) of the present invention was present at the same time) and an aqueous phase containing water soluble ions. The aqueous phase was removed by decantation. 5 g of the resulting silver laurate (+ silver bromide) and 3.0 g of polyvinyl butyral were added to 20 ml of isopropyl alcohol and the mixture was ball milled to produce a polymer dispersion of the silver salt (c). To this polymer dispersion (c), materials of the following Composition (III) were added to produce a heat-developable Photosensitive Material (C - 1).

| Composition (III) | |
|---|---|
| Dye (3) ($8 \times 10^{-4}$ mols/liter, 2-methoxyethanol solution) | 2 cc |
| Phthalazinone (3% methanol solution) | 8 cc |
| Reducing Agent* (20% acetone solution) | 5 cc |

*The same reducing agent as used in Example 1. For the purposes of comparison, a heat-developable Photosensitive Material (C - 2) was produced without using Dye (3). Furthermore, a heat-developable Photosensitive Material (C - 3) was produced using Dye (22) ($8 \times 10^{-4}$ mols/liter, 2-methoxyethanol solution: 2 cc) for comparison Dye (22)

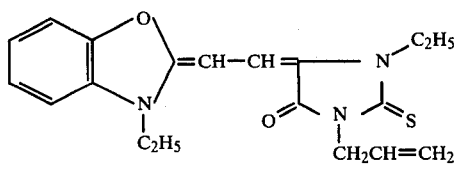

Photosensitive Materials (C - 1), (C - 2) and (C - 3) were exposed and developed using the same conditions as in Example 1 to obtain black images.

The relative speeds based on the speed of the heat-developable Photosensitiv Material (C - 3) being 100 were as follows.

Table

| | Photosensitive Material | | |
|---|---|---|---|
| | (C - 1) | (C - 2) | (C - 3) |
| Relative Speed | 1750 | 18 | 100 |

As is clear from these results, the sensitizing dye of the present invention shows excellent sensitivity at blue light exposure.

EXAMPLE 3

A heat-developable Photosensitive Material (B - 5) was produced using Dye (2) instead of Dye (1) in Example 1 ($8\times10^{-4}$ mols/liter, 2-methoxyethanol solution: 2 cc).

Photosensitive Material (B - 5) was exposed to light and developed under the same conditions as in Example 1 to obtain a black image. The relative speed of Photosensitive Material (B - 5) based on the speed of Photosensitive Material (B - 2) being 100 was 1300.

COMPARATIVE EXAMPLE 1

A heat-developable Photosensitive Material (C-5) was produced using Dye (23) does not have a carboxyl group, instead of Dye (3) in Example 2 ($8\times10^{-4}$mols/-liter, 2-methoxyethanol solution: 2cc).

Photosensitive Material (C - 5) was exposed to light and developed under the same conditions as in Example 1 to obtain a black image. The relative speed of Photosensitive Material (C - 5) based on the speed of Photosensitive Material (C - 2) being 100 was 2850.

Accordingly, as compared with Example 2, (C - 1) can have about 97 times the sensitization as the Photosensitive material (C - 2) which does not use a sensitizing agent, on the other hand, (C - 5) has a sensitization only 28.5 times as much as that. Consequently, it was that a sensitization degree could be increased by using carboxyl group containing materials.

Dye (23)

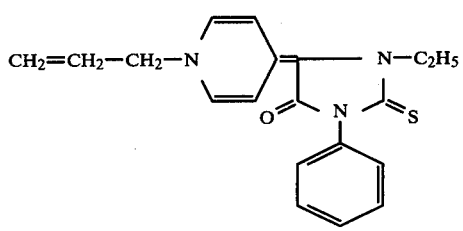

EXAMPLE 4

3.4 g of behenic acid was dissolved in 100 ml of toluene at 60° C. The temperature was kept to 60° C. To this solution, 100 ml of a dilute aqueous solution of nitric acid having a pH of 2.0 (25° C.) was added while stirring. This mixture was kept at 60° C. while stirring with a stirrer, and an aqueous solution of silver ammonium complex salt prepared by adding an ammonia solution to 80 ml of an aqueous solution containing 1.7 g of silver nitrate and adding water to make the total 100 ml was added thereto. Thus, a dispersion containing microcrystals of silver behenate was obtained. When this dispersion was allowed to stand for 20 minutes at room temperature, the dispersion separated into an aqueous phase and a toluene phase.

Then the aqueous phase was removed and the toluene phase was washed with 400 ml of fresh water by decantation. After this treatment had been repeated 3 times, 400 ml of water was added, and silver behenate was removed by centrifugal separation. Thus 4 g of spindle shaped silver behenate crystals having a length of about 1 micron and a diameter of about 0.05 were obtained.

25 g of this silver behenate was added to 20 ml of an isopropyl alcohol solution containing 2 g of polyvinyl butyral, and the mixture was ball-milled for 1 hour to produce a polymer dispersion (D). To 20 ml of this polymer dispersion (D) of the silver salt, the following Composition (IV) was added to produce a heat-developable photosensitive composition. This composition was applied to a paper support at a coverage of 0.4 g of silver per $m^2$ of the support to produce a heat-developable Photosensitive Material (D - 1).

| Composition (IV) | |
|---|---|
| Ammonium Bromide (2.5% methanol solution) | 1 ml |
| Dye (1) ($8\times10^{-4}$ mols/liter, 2-methoxyethanol solution) | 3 cc |
| Phthalazinone (3% methanol solution) | 8 cc |
| 2,2'-Methylenebis-(6-t-butyl-4-methylphenol) (25% 2-methoxyethanol solution) | 4 cc |

For the purposes of comparison, a heat-developable Photosensitive Material (D - 2) was produced using Dye (21) instead of Dye (1) (amount added: $8\times10^{-4}$ mols/liter, 2-methoxyethanol solution: 3 cc).

These Photosensitive Materials (D - 1) and (D - 2) were exposed to light through an optical wedge through a filter having a transmission peak at 420 nm (half value width: 50 nm) using a tungsten light source and developed by heating to 120° C. for 20 seconds to obtain black images. Then the reflection density was determined. The reciprocal of the exposure necessary to provide a reflection density of 0.1 higher than fog was selected as the standard. The relative speed of Photosensitive Material (D - 1) based on the speed of Photosensitive Material (D - 2) being 100 was 1800.

The relative speed of the heat-developable photosensitive material wherein no dye had been employed was 13.

EXAMPLE 5

A heat-developable Photosensitive Material (B - 6) was produced using Dye (7) instead of Dye (1) in Example 1 ($8\times10^{-4}$ mols/liter, 2-methoxyethanol solution: 2 cc).

Photosensitive Material (B - 6) was exposed to light and developed under the same conditions as in Example 1 to obtain a black image. The relative speed of Photosensitive Material (B - 6) based on the speed of Photosensitive Material (B - 2) being 100 was 1650.

EXAMPLE 6

A heat-developable Photosensitive Material (B - 7) was produced using Dye (9) instead of Dye (1) in Example 1 ($8\times10^{-4}$ mols/liter, 2-methoxyethanol solution: 2 cc).

Photosensitive Material (B - 7) was exposed to light and developed under the same conditions as in Example 1 to obtain a black image. The relative speed of Photosensitive Material (B - 7) based on the speed of Photosensitive Material (B - 2) being 100 was 1400.

EXAMPLE 7

A heat-developable Photosensitive Material (B - 8) was produced using Dye (12) instead of Dye (1) in Example 1 ($8\times10^{-4}$ mols/liter, 2-methoxyethanol solution: 2cc).

Photosensitive Material (B - 8) was exposed to light and developed under the same conditions as in Example 1 to obtain a black image. The relative speed of Photosensitive Material (B - 8) based on the speed of Photosensitive Material (B - 2) being 100 was 1050.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material which comprises a support having thereon at least one layer containing, (a) an organic silver salt, (b) a catalytic amount of a photosensitive silver halide or a compound which forms a photosensitive silver halide on reaction with the organic silver salt (a), (c) a reducing agent, (d) at least one sensitizer selected from the group consisting of the compounds represented by the following formulae (I) and (II):

(I)

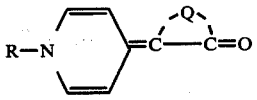

(II)

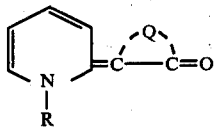

wherein R represents an unsubstituted or substituted alkyl group having 1 to 4 carbon atoms or an unsubstituted or substituted aryl group, and Q represents a group of atoms necessary to complete a rhodanine nucleus, a thiohydantoin nucleus or a 2-thio-2,4-oxazolidine-dione nucleus, which nucleus contains in the 3-position thereof a carbon-containing substituent having 1 to 15 carbon atoms and wherein at least one of R and said carbon-containing substituent is substituted with a carboxyl group, and (e) a binder.

2. The heat-developable photosensitive material of claim 1, wherein said nucleus formed by Q contains a carbon-containing substituent having 1 to 15 carbon atoms in the 3-position.

3. The heat-developable photosensitive material of claim 2, wherein said carbon-containing substituent in the 3-position of the Q nucleus is an alkyl group having 1 to 8 carbon atoms, an alkenyl group having 2 to 4 carbon atoms or an aryl group having 6 to 12 carbon atoms.

4. The heat-developable photosensitive material of claim 3, wherein said alkyl group is an unsubstituted alkyl group, a carboxyalkyl group, a sulfoalkyl group, a hydroxyalkyl group, an aralkyl group or a vinylmethyl group and wherein said aryl group is an unsubstituted aryl group, a carboxyaryl group, a sulfoaryl group or an alkaryl group.

5. The heat-developable photosensitive material of claim 2, wherein said carbon-containing substituent in the 3-position of the Q nucleus contains a hydroxy group, a carboxy group, a sulfo group, or an alkali metal salt of a sulfo group as a substituent.

6. The heat-developable photosensitive material of claim 1, wherein Q represents the group of atoms necessary to form a thiohydantoin nucleus containing a carbon-containing substutuent having 1 to 15 carbon atoms in the 1-position of the thiohydantoin nucleus.

7. The heat-developable photosensitive material of claim 6, wherein said carbon-containing substituent in the 1-position of said thiohydantion nucleus is an alkyl group having 1 to 8 carbon atoms, an alkenyl group having 2 to 4 carbon atoms, or an aryl group having 6 to 12 carbon atoms.

8. The heat-developable photosensitive material of claim 7, wherein said alkyl group is an unsubstituted alkyl group, a carboxyalkyl group, a sulfoalkyl group, a hydroxyalkyl group, an aralkyl group or a vinylmethyl group and wherein said aryl group is an unsubstituted aryl group, a carboxyaryl group, a sulfoaryl group or an alkaryl group.

9. The heat-developable photosensitive material of claim 1, wherein said sensitizer is present in an amount of about $10^{-6}$ to $10^{-1}$ mol per mol of said organic silver salt (a).

10. The heat-developable photosensitive material of claim 9, wherein the amount of said sensitizer is $10^{-4}$ to $10^{-2}$ mol per mol of said organic silver salt (a).

11. The heat-developable photosensitive material of claim 1, including a toning agent.

12. The heat-developable photosensitive material of claim 11, wherein said toning agent is a phthalimide oran oxazinedione.

13. The heat-developable photosensitive material of claim 1, wherein said organic silver salt is silver laurate.

14. The heat-developable photosensitive material of claim 1, wherein said reducing agent is a substituted phenol.

15. The heat-developable photosensitive material of claim 1, wherein said reducing agent is an unsubstituted or substituted bisphenol.

16. The heat-developable photosensitive material of claim 1, wherein said at least one sensitizer (d) is selected from the group consisting of the following compounds

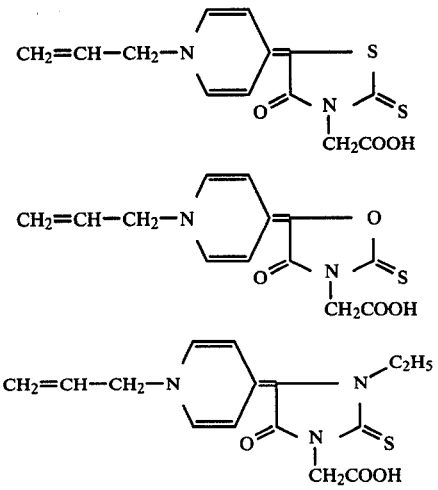

-continued
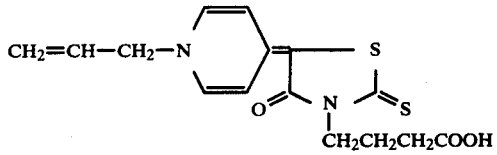
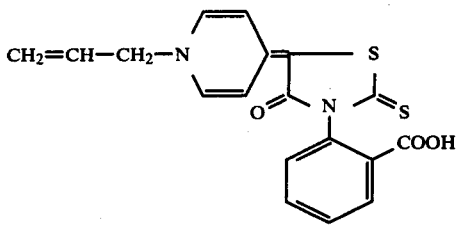
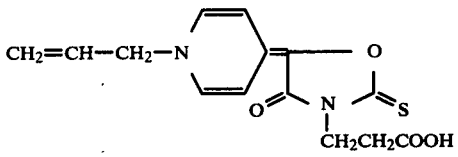
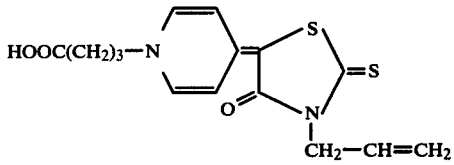
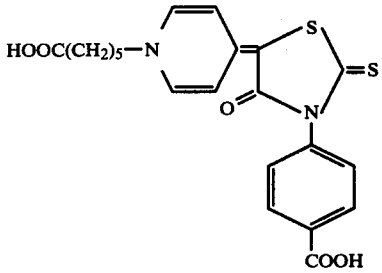
-continued
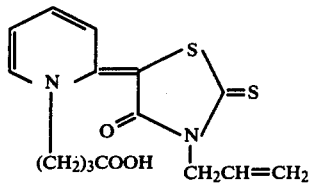
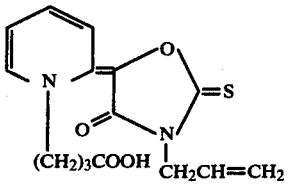
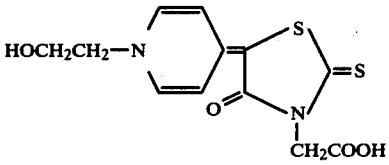
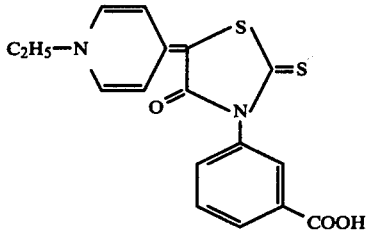
and
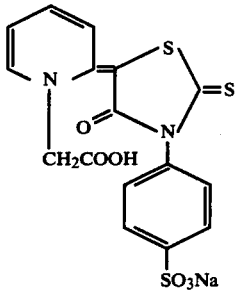
17. The heat-developable photosensitive material of claim 1, wherein said at least one of said R and said carbon-containing substituent is selected from the group consisting of a carboxyalkyl group and a carboxyaryl group.
* * * * *